US006906667B1

(12) United States Patent
Poilasne et al.

(10) Patent No.: US 6,906,667 B1
(45) Date of Patent: Jun. 14, 2005

(54) MULTI FREQUENCY MAGNETIC DIPOLE ANTENNA STRUCTURES FOR VERY LOW-PROFILE ANTENNA APPLICATIONS

(75) Inventors: Gregory Poilasne, San Diego, CA (US); Laurent Desclos, San Diego, CA (US); Sebastian Rowson, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 10/076,922

(22) Filed: Feb. 14, 2002

(51) Int. Cl.[7] ..... H01Q 1/36; H01Q 1/38
(52) U.S. Cl. ..... 343/700 MS; 343/895
(58) Field of Search ..... 343/700 MS, 702, 343/846, 895, 741, 866; H01Q 1/38, 1/36

(56) References Cited

U.S. PATENT DOCUMENTS

| | | | | |
|---|---|---|---|---|
| 3,648,172 | A | | 3/1972 | Nakahara et al. |
| 3,721,990 | A | | 3/1973 | Gibson et al. |
| 3,827,053 | A | | 7/1974 | Willie et al. |
| 3,845,487 | A | | 10/1974 | Lammers |
| 4,328,502 | A | | 5/1982 | Scharp |
| 4,684,952 | A | | 8/1987 | Munson et al. |
| 5,087,922 | A | | 2/1992 | Tang et al. |
| 5,184,144 | A | | 2/1993 | Thombs |
| 5,241,321 | A | | 8/1993 | Tsao |
| 5,337,065 | A | | 8/1994 | Bonnet et al. |
| 5,450,090 | A | | 9/1995 | Gels et al. |
| 5,627,550 | A | | 5/1997 | Sanad |
| 5,726,666 | A | | 3/1998 | Hoover et al. |
| 5,754,143 | A | | 5/1998 | Warnagiris et al. |
| 5,781,158 | A | | 7/1998 | Ko et al. |
| 5,790,080 | A | | 8/1998 | Apostolos |
| 5,900,843 | A | | 5/1999 | Lee |
| 5,936,590 | A | | 8/1999 | Funder |
| 5,943,020 | A | | 8/1999 | Liebendoerfer et al. |
| 5,966,097 | A | * | 10/1999 | Fukasawa et al. ... 343/700 MS |
| 6,008,762 | A | | 12/1999 | Nghiem |
| 6,008,764 | A | | 12/1999 | Ollikainen et al. |
| 6,114,996 | A | | 9/2000 | Nghiem |
| 6,133,880 | A | | 10/2000 | Grangeat et al. |
| 6,195,051 | B1 | | 2/2001 | McCoy et al. |
| 6,295,028 | B1 | | 9/2001 | Jonsson et al. |
| 6,304,222 | B1 | * | 10/2001 | Smith et al. ..... 343/702 |

(Continued)

FOREIGN PATENT DOCUMENTS

| | | | |
|---|---|---|---|
| EP | 0 604 338 | A | 6/1994 |
| EP | 0 942 488 | A | 9/1999 |
| EP | 1 067 627 | A | 1/2001 |
| JP | 56 012102 | | 2/1981 |
| JP | 09 055621 | A | 2/1997 |
| JP | 2000 031735 | A | 1/2000 |
| JP | 2000 068736 | A | 3/2000 |

OTHER PUBLICATIONS

International Search Report from PCT Application No. PCT/US02/04228.
International Search Report from PCT Application No. PCT/US02/20242.
International Search Report for application PCT/US03/37031 dated Apr. 5,2004.

*Primary Examiner*—Hoanganh Le
(74) *Attorney, Agent, or Firm*—Foley & Lardner LLP

(57) ABSTRACT

A capacitively loaded magnetic dipole is configured with an E-field distribution so that the thickness of the antenna can be reduced while still maintaining high efficiency. The basic antenna element comprises a ground plane; a first conductor extending longitudinally above the ground plane having a first end electrically connected to the ground plane; a second conductor extending longitudinally above the ground plane and parallel to the first conductor, the second conductor also having a first electrically connected to the ground plane; and an antenna feed coupled to the first conductor. Both of the conductors are spaced equidistantly above the ground plane.

30 Claims, 20 Drawing Sheets

U.S. PATENT DOCUMENTS 6,323,810 B1 11/2001 Poilasne et al.
6,348,894 B1 * 2/2002 Lahti ..... 343/702
6,362,789 B1 3/2002 Trumbull et al.
6,366,258 B2 4/2002 Reece et al.
6,381,471 B1 4/2002 Dvorkin
6,404,392 B1 6/2002 Blom
6,417,807 B1 7/2002 Hsu et al.
6,529,749 B1 3/2003 Hayes et al.

* cited by examiner

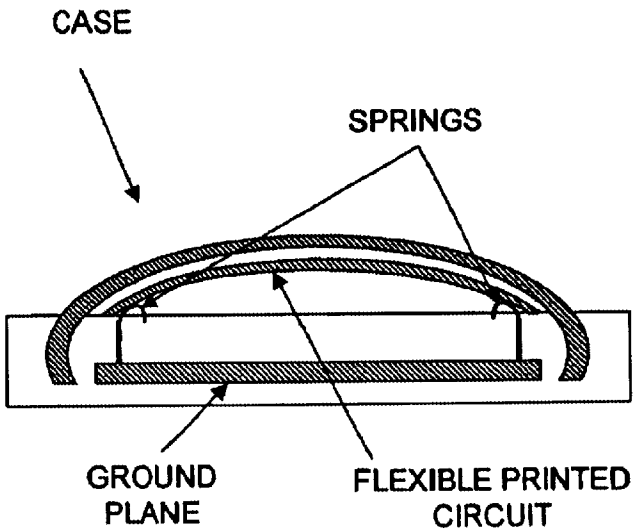
Fig. 20
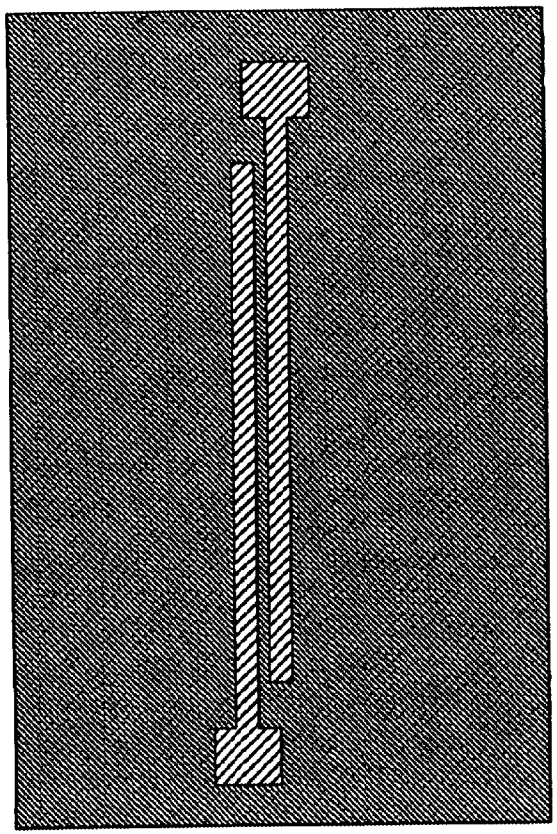

MULTI FREQUENCY MAGNETIC DIPOLE ANTENNA STRUCTURES FOR VERY LOW-PROFILE ANTENNA APPLICATIONS

REFERENCES TO RELATED APPLICATIONS

This application is related to our co-pending application Ser. No. 09/892,928 filed on Jun. 26, 2001, entitled "Multi Frequency Magnetic Dipole Antenna Structure and Methods of Reusing the Volume of an Antenna", and incorporated herein by reference.

This application also relates to U.S. Pat. No. 6,323,810, entitled "Multimode Grounded Finger Patch Antenna" by Gregory Poilasne et al., which is owned by the assignee of this application and incorporated herein by reference.

Furthermore, this application relates to co-pending application Ser. No. 09/781,779, entitled "Spiral Sheet Antenna Structure and Method" by Eli Yablonovitch et al., owned by the assignee of this application and incorporated herein by reference.

BACKGROUND OF THE INVENTION

1. Field of the Invention

The present invention relates generally to the field of wireless communications, and particularly to the design of an antenna.

2. Background

Small antennas are required for portable wireless communications. With classical antenna structures, a certain physical volume is required to produce a resonant antenna structure at a particular radio frequency and with a particular bandwidth. A fairly large volume is required if a large bandwidth is desired. Our previously filed application Ser. No. 09/892,928 addresses the need for a small compact antenna with wide bandwidth. The present invention addresses the need for a wide-bandwidth, compact antenna that has a very low profile.

SUMMARY OF THE INVENTION

The present invention provides a capacitively loaded magnetic dipole with an E-field distribution so that the thickness of the antenna can be reduced while still maintaining high efficiency. The basic antenna element comprises a ground plane; a first conductor extending longitudinally above the ground plane having a first end electrically connected to the ground plane; a second conductor extending longitudinally above the ground plane and parallel to the first conductor, the second conductor also having a first end electrically connected to the ground plane; and an antenna feed coupled to the first conductor. Both of the conductors are spaced equidistantly above the ground plane. Additional parasitic elements, which may be parallel or non-parallel to the driven element, may be used to increase the bandwidth of the antenna. The parasitic elements are tuned to a slightly different frequency in order to obtain a multi-resonant antenna structure. The frequencies of the resonant modes can either be placed close enough to achieve the desired overall bandwidth or can be placed at different frequencies to achieve multi-band performance. Various embodiments are disclosed.

BRIEF DESCRIPTION OF THE DRAWINGS

FIG. 20 shows how a basic element of the antenna can be made using a flexible substrate placed inside an enclosure.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
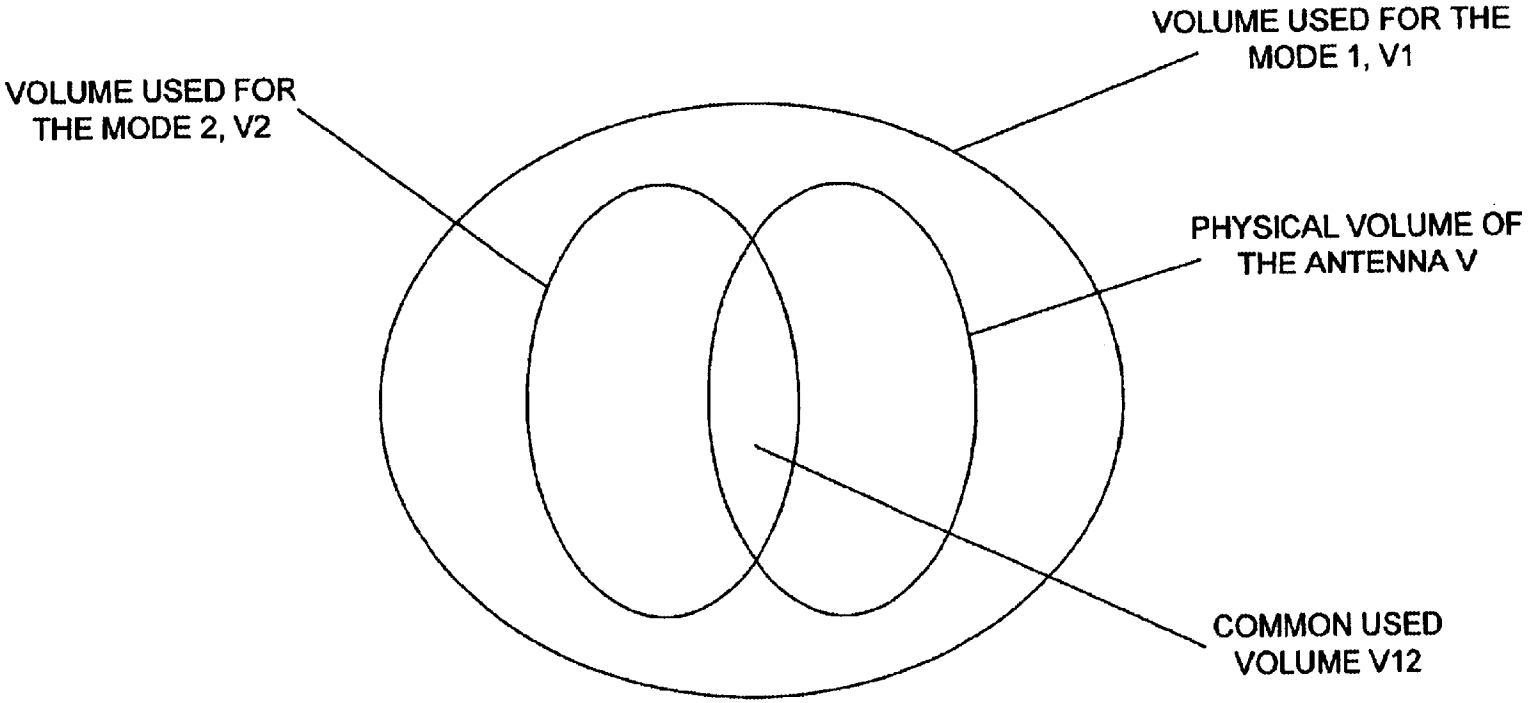
FIG. 1 conceptually illustrates the antenna designs of the present invention.

The volume to bandwidth ratio is one of the most important constraints in modern antenna design. One approach to increasing this ratio is to re-use the volume for different orthogonal modes. Some designs, such as the Grounded Multifinger Patch disclosed in patent application Ser. No. 09/901,134, already use this approach, even though the designs do not optimize the volume to bandwidth ratio. In the previously mentioned patent application, two modes are generated using the same physical structure, although the modes do not use exactly the same volume. The current repartition of the two modes is different, but both modes nevertheless use a common portion of the available volume. This concept of utilizing the physical volume of the antenna for a plurality of antenna modes is illustrated generally in FIG. 1. V is the physical volume of the antenna, which has two radiating modes. The physical volume associated with the first mode is designated V1, whereas that associated with the second mode is designated V2. It can be seen that a portion of the physical volume, designated V12, is common to both of the modes.

We will express the concept of volume reuse and its frequency dependence with what we refer to as a "K law". The common general K law is defined by the following:

$$\Delta f/f=K\cdot V/\lambda^3$$

$\Delta f/f$ is the normalized frequency bandwidth. $\lambda$ is the wavelength. The term V represents the volume that will enclose the antenna. This volume so far has been a metric and no discussion has been made on the real definition of this volume and the relation to the K factor.

In order to have a better understanding of the K law, different K factors are defined:

$K_{modal}$ is defined by the mode volume $V_i$, and the corresponding mode bandwidth:

$$\Delta f_i/f_i=K_{modal}\cdot V_i/\lambda_i^3$$

where i is the mode index.

$K_{modal}$ is thus a constant related to the volume occupied by one electromagnetic mode.

$K_{effective}$ is defined by the union of the mode volumes $V_1 \cup V_2 \cup \ldots V_i$ and the cumulative bandwidth. It can be thought of as a cumulative K;

$$\Sigma_i \Delta f_1/f_i=K_{effective}\cdot(V_1 \cup V_2 \cup \ldots V_i)/\lambda_C^3$$

where $\lambda_c$ is the wavelength of the central frequency.

$K_{effective}$ is a constant related to the minimum volume occupied by the different excited modes taking into account the fact that the modes share a part of the volume. The different frequencies $f_1$ must be very close in order to have nearly overlapping bandwidths.

$K_{physical}$ or $K_{observed}$ is defined by the structural volume V of the antenna and the overall antenna bandwidth:

$$\Delta f/f=K_{physical}\cdot V/\lambda^3$$

$K_{physical}$ or $K_{observed}$ is the most important K factor since it takes into account the real physical parameters and the usable bandwidth. $K_{physical}$ is also referred to as $K_{observed}$ since it is the only K factor that can be calculated experimentally. In order to have the modes confined within the physical volume of the antenna, $K_{physical}$ must be lower than $K_{effective}$. However these K factors are often nearly equal. The best and ideal case is obtained when $K_{physical}$ is approximately equal to $K_{effective}$ and is also approximately equal to the smallest $K_{modal}$. It should be noted that confining the modes inside the antenna is important in order to have a well-isolated antenna.

One of the conclusions from the above calculations is that it is important to have the modes share as much volume as possible in order to have the different modes enclosed in the smallest volume possible.

Figure 2:
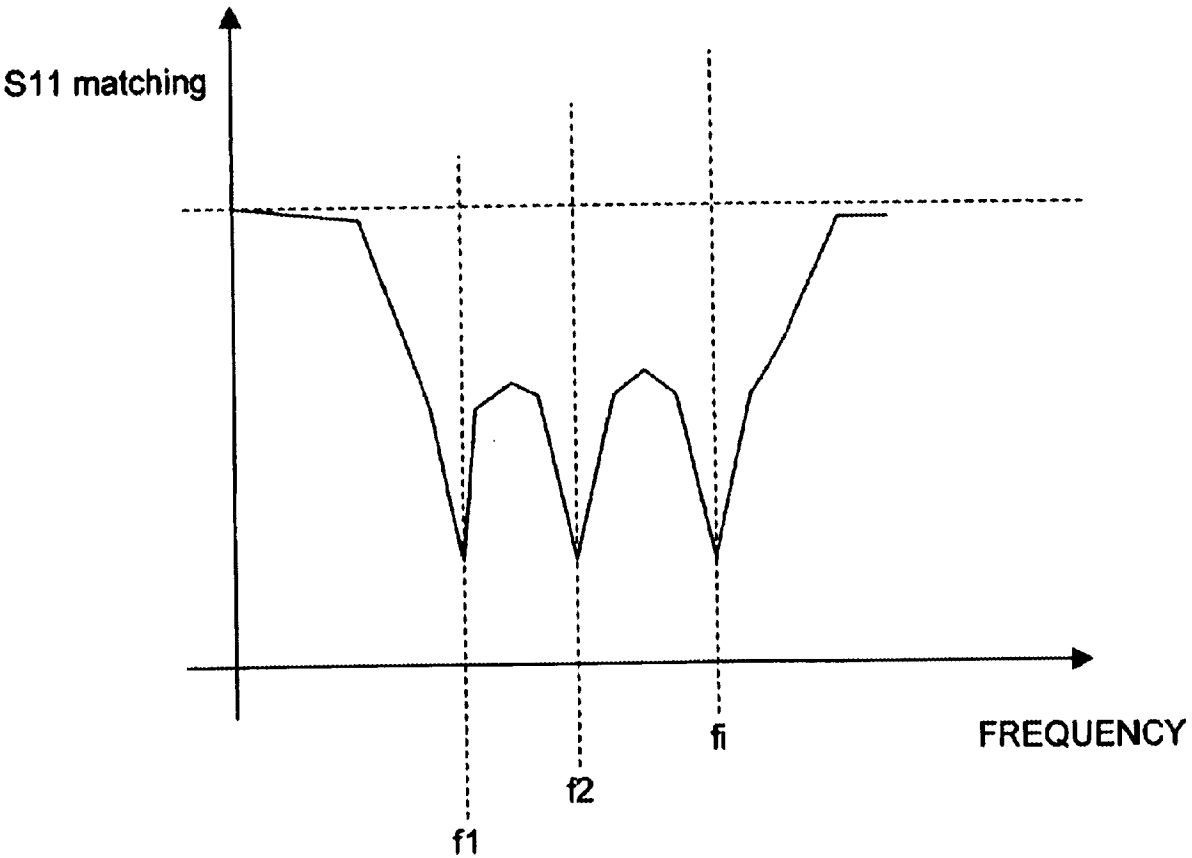
FIG. 2 illustrates the increased overall bandwidth achieved with a multiresonant antenna design.

For a plurality of radiating modes i, FIG. 2 shows the observed return loss of a multiresonant structure. Different successive resonances occur at the frequencies $f_1, f_2, f_i, \ldots, f_n$. These peaks correspond to the different electromagnetic modes excited inside the structure. FIG. 2 illustrates the relationship between the physical or observed K and the bandwidth over $f_1$ to $f_n$.

Figure 3:
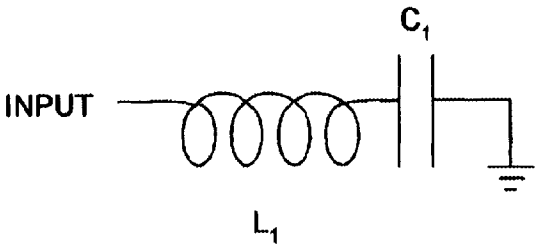
FIG. 3 is an equivalent circuit for a radiating structure.

For a particular radiating mode with a resonant frequency at $f_1$, we can consider the equivalent simplified circuit $L_1C_1$, shown in FIG. 3. By neglecting the resistance in the equivalent circuit, the bandwidth of the antenna is simply a function of the radiation resistance. The circuit of FIG. 3 can be repeated to produce an equivalent circuit for a plurality of resonant frequencies.

Figure 4:
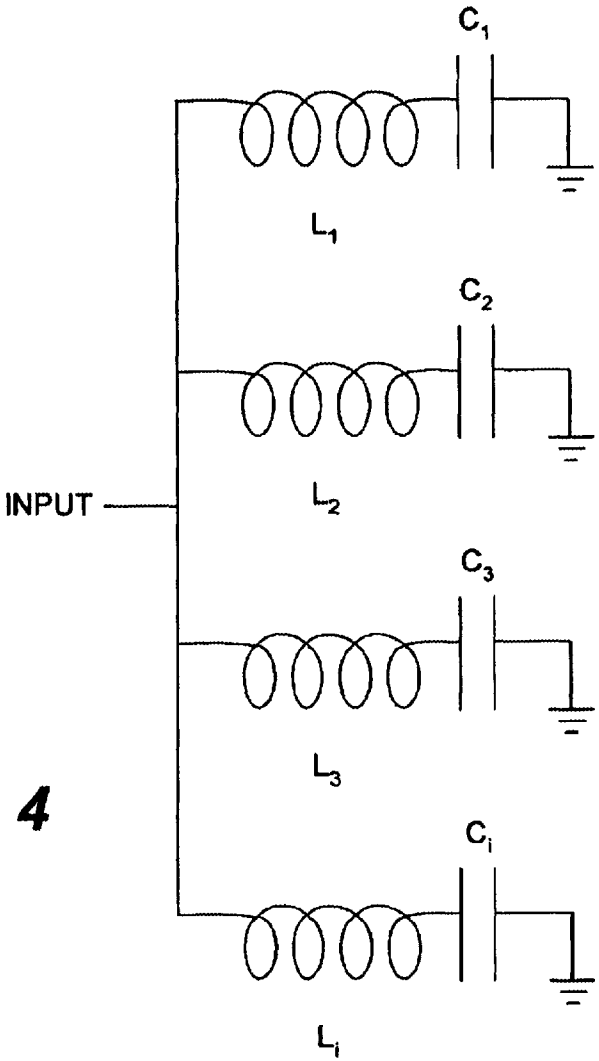
FIG. 4 is an equivalent circuit for a multiresonant antenna structure.

FIG. 4 illustrates a multiresonant antenna represented by a plurality of LC circuits. At the frequency $f_1$ only the circuit $L_1C_1$ is resonating. Physically, one part of the antenna structure resonates at each frequency within the covered spectrum. Again, neglecting real resistance of the structure, the bandwidth of each mode is a function of the radiation resistance.

As discussed above, in order to optimize the K factor, the antenna volume must be reused for the different resonant modes. One example of a multimode antenna utilizes a capacitively loaded microstrip type of antenna as the basic radiating structure. Modifications of this basic structure will be subsequently described. In all of the described examples, the elements of the multimode antenna structures have closely spaced resonant frequencies.

Figure 5:
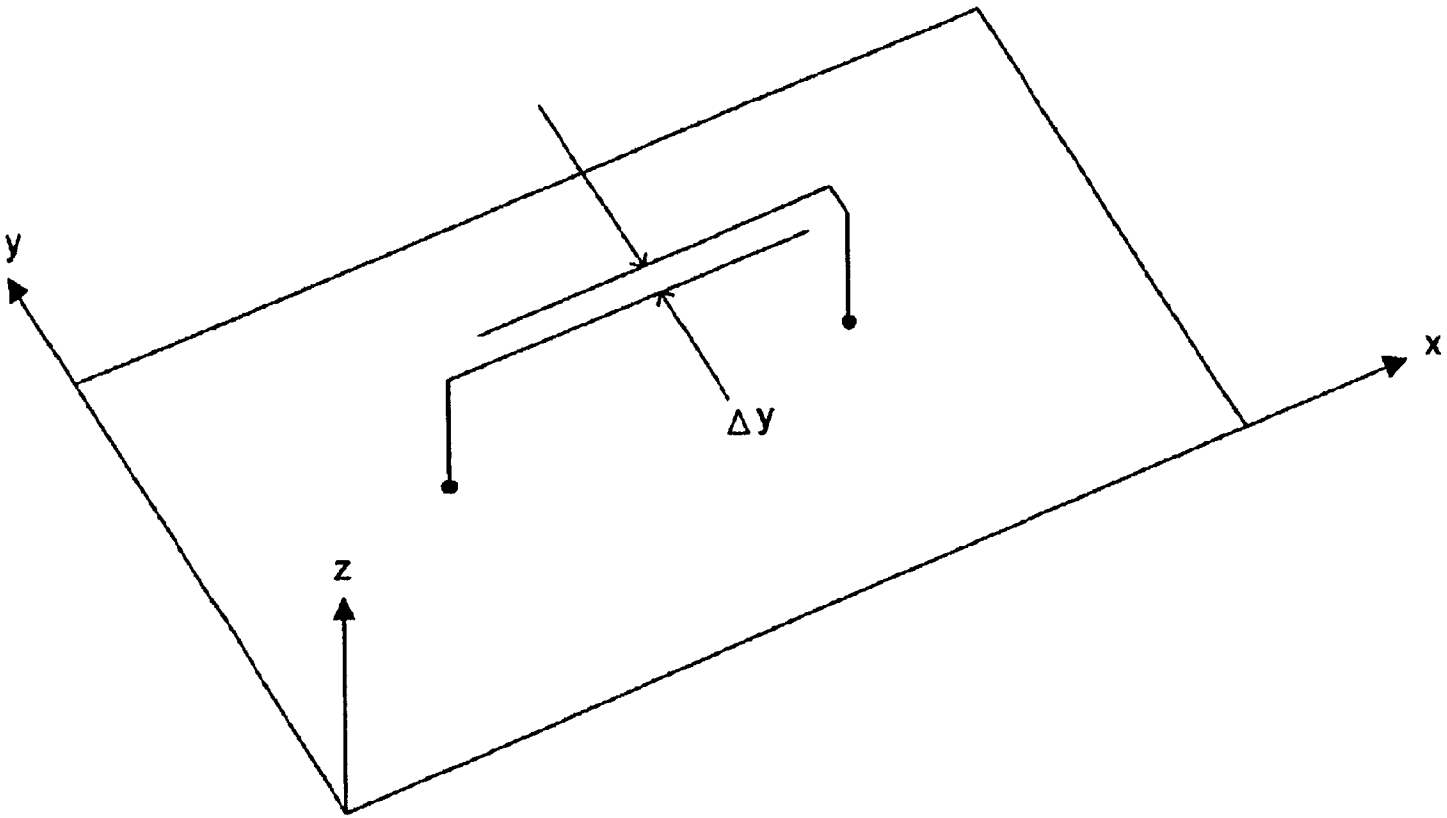
FIG. 5 illustrates a basic radiating element of a low profile embodiment of the present invention.
Figure 6:
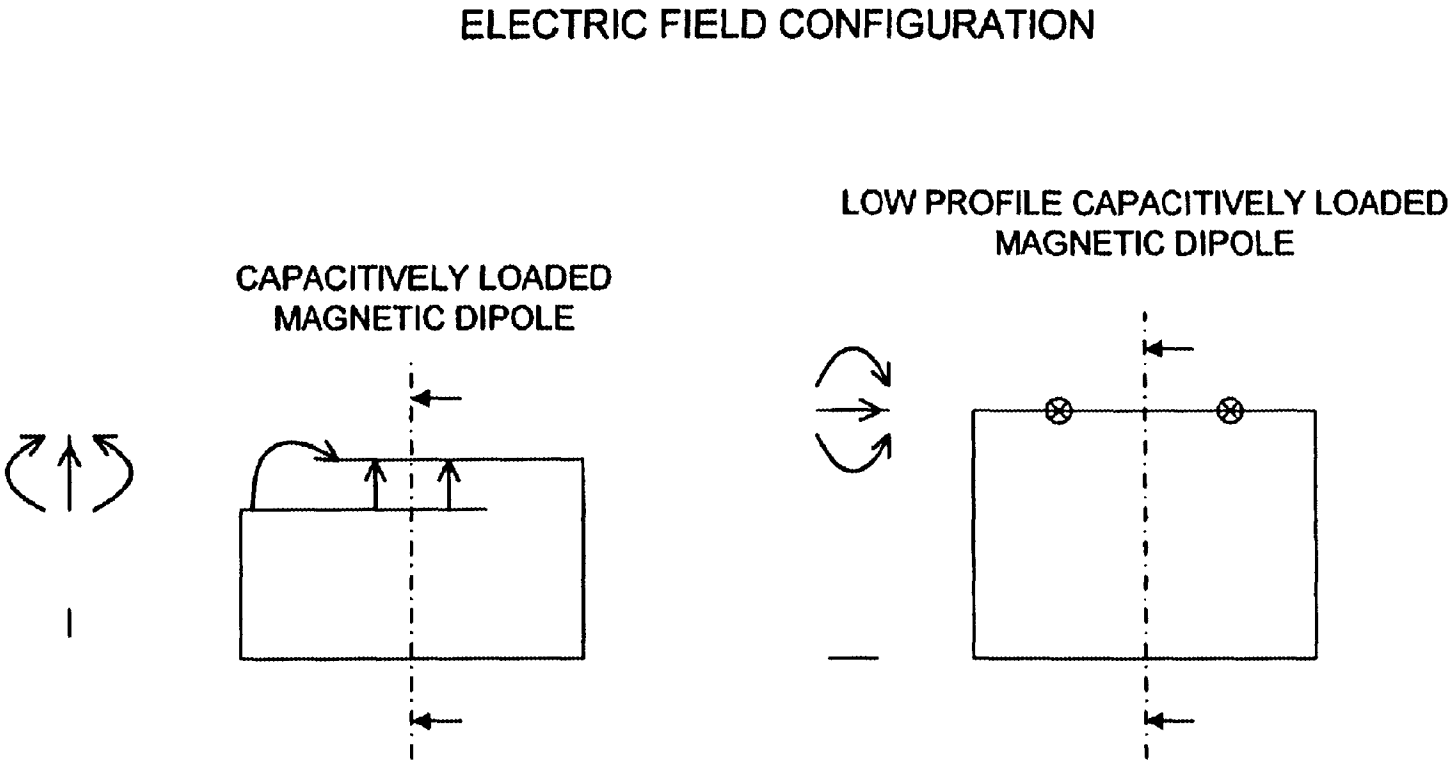
FIG. 6 illustrates the field configuration for the basic element shown in FIG. 5.

The concept of utilizing the physical volume of the antenna for a plurality of antenna modes has been described in our earlier application. In the embodiments described therein, different modes are excited using one excited element and additional parasitic elements tuned to a slightly different frequency. The magnetic coupling between the different elements is enough to excite the different resonances. With reference to FIG. 5, different embodiments will now be described in which the two conductors of a radiating element are at the same z elevation in an x-y plane rather than being in an x-z plane as was the case in our earlier application. For the antenna structure of FIG. 5, the two conductors are spaced apart by a distance $\Delta y$. The electric field is horizontal as shown in FIG. 6. The horizontal E-field reduces the interaction with the ground plane, and the height of the antenna can be reduced while keeping the same electromagnetic characteristics. Even if the electric field interacts with the ground, its configuration remains nearly identical.

Figure 7:
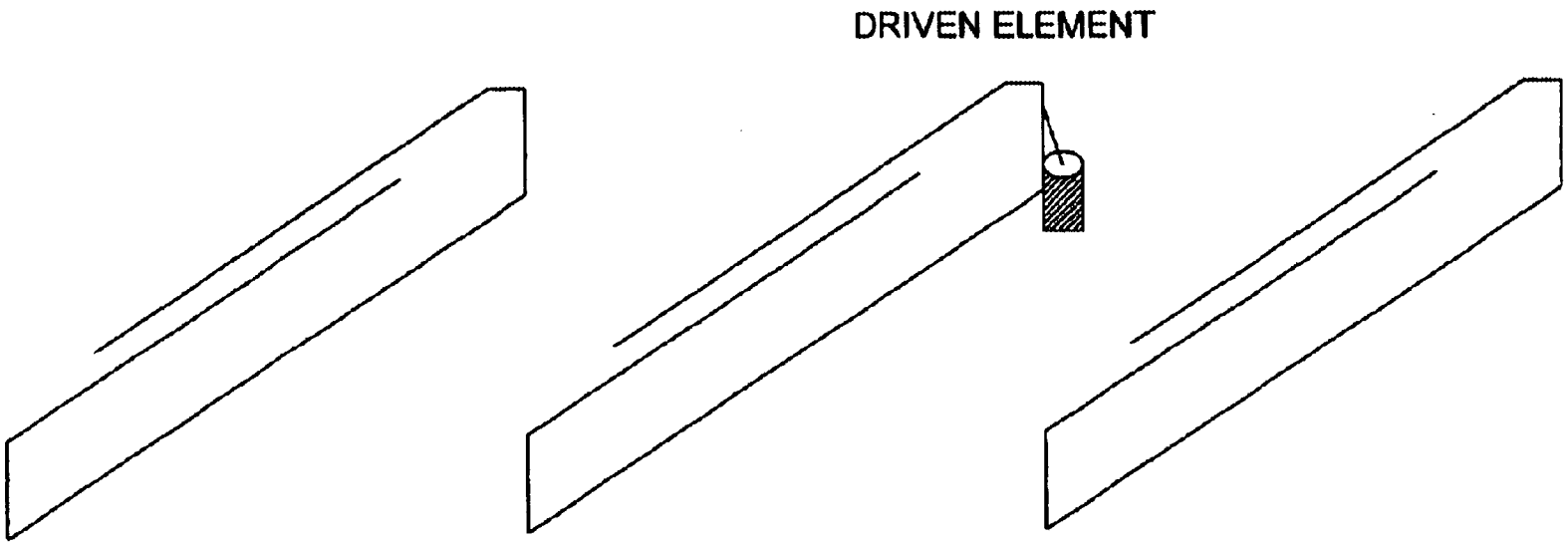
FIG. 7 illustrates a low-profile antenna having a driven element and additional parasitic elements.
Figure 8:
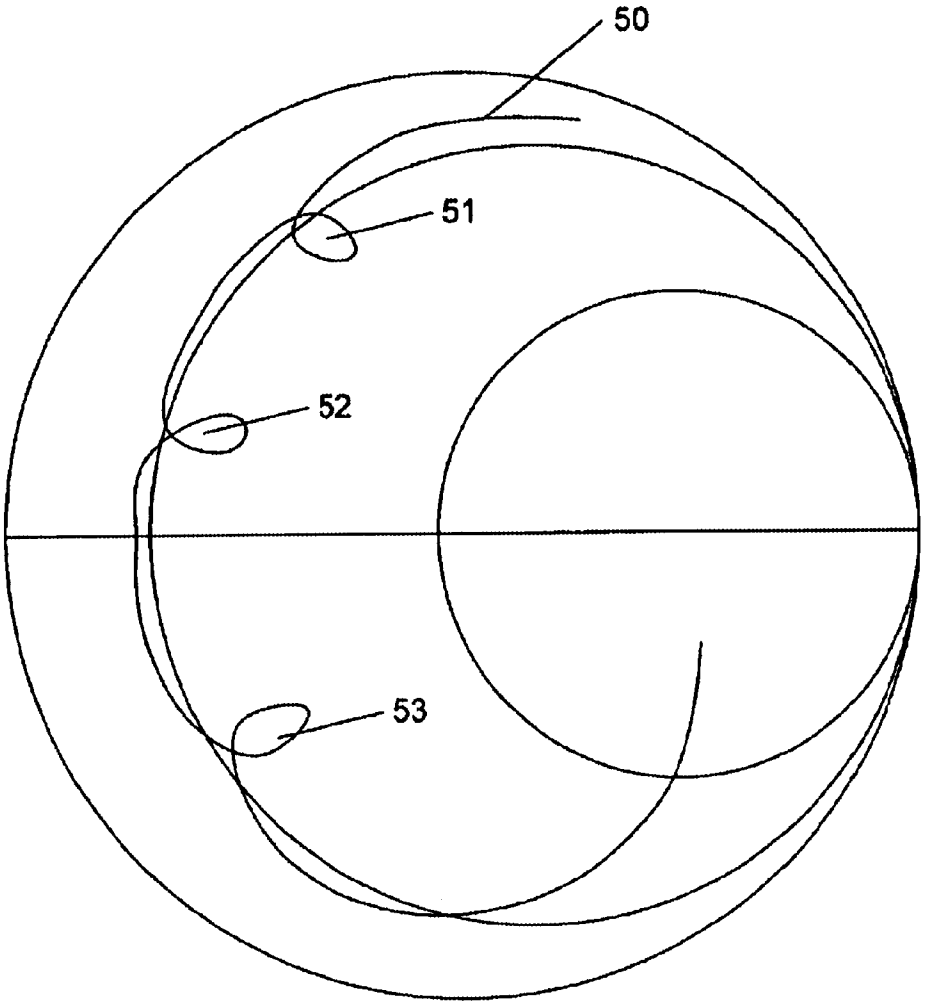
FIG. 8 is a Smith chart illustrating a non-optimized multiresonant antenna

Multiple elements can be placed parallel to each other as shown in FIG. 7. Here, only one element is driven and the others are parasitic. There is a magnetic coupling between the main, driven element and the parasitic elements. This magnetic coupling creates multiple resonances. If the resonances are close enough in frequency, then it is possible to have a wide bandwidth antenna, keeping a small volume and a low profile. Impedence matching of this structure is illustrated by the Smith chart shown in FIG. 8. The large outer loop 50 corresponds to the main driven element 40, whereas the smaller loops 51–53 correspond to the parasitic elements. This is a representation of a non-optimized structure. Various adjustments can be made to the antenna elements to influence the positions of the loops on the Smith chart. The smaller loops may be gathered in the same area in order to obtain a constant impedance within the overall frequency range.

Figure 9:
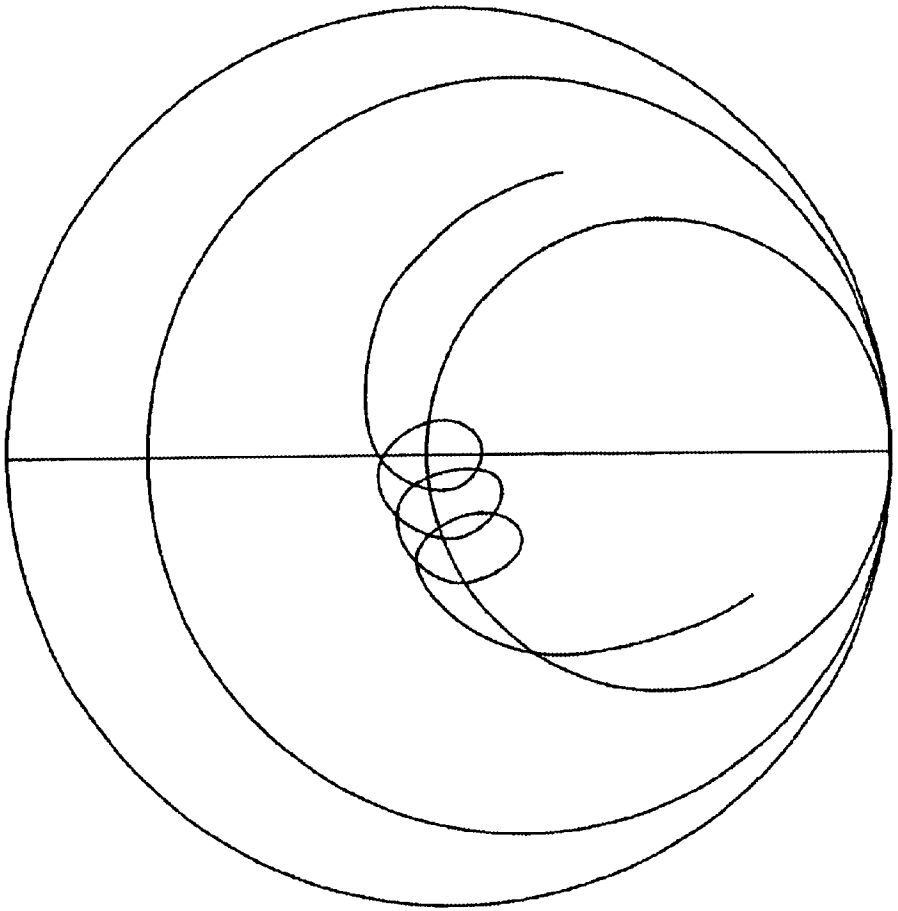
FIG. 9 is a Smith chart illustrating an optimized multi-resonant antenna

In the case of a typical 50 ohm connection, an optimized structure will have all of the loops gathered approximately in the center of the Smith chart as shown in FIG. 9. In order to gather the loops in the center of the Smith chart (or wherever it is desired to place them), the dimensions of the individual antenna elements are adjusted, keeping in mind that each loop corresponds to one element.

Figure 10:
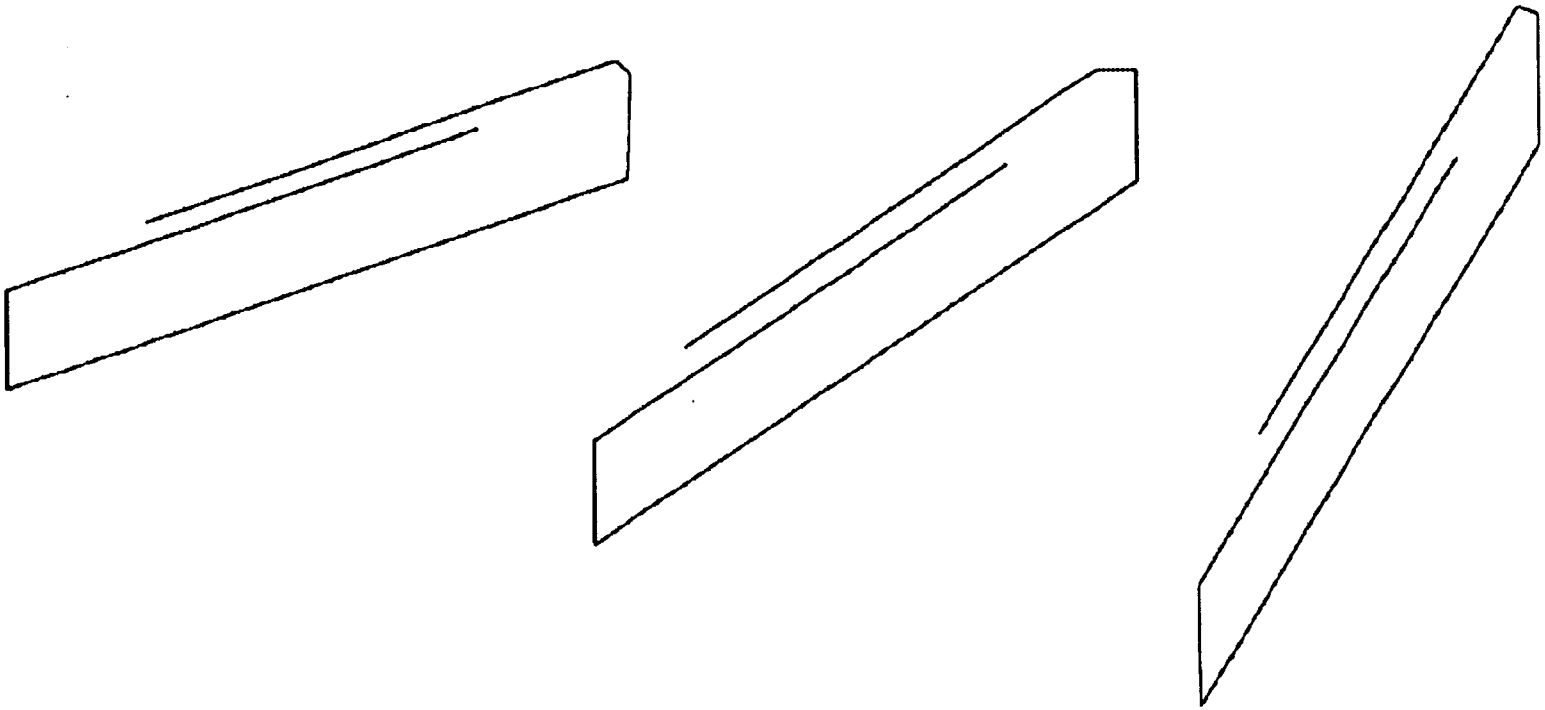
FIG. 10 illustrates an antenna according to the present invention with non-parallel radiating elements.

With reference to FIG. 10, the different elements do not have to be parallel to obtain the desired behavior. This actually gives greater flexibility in matching the antenna to the impedance of the feeding point, which may be 50 ohms or may be a different value as a matter of design choice.

Figure 11:
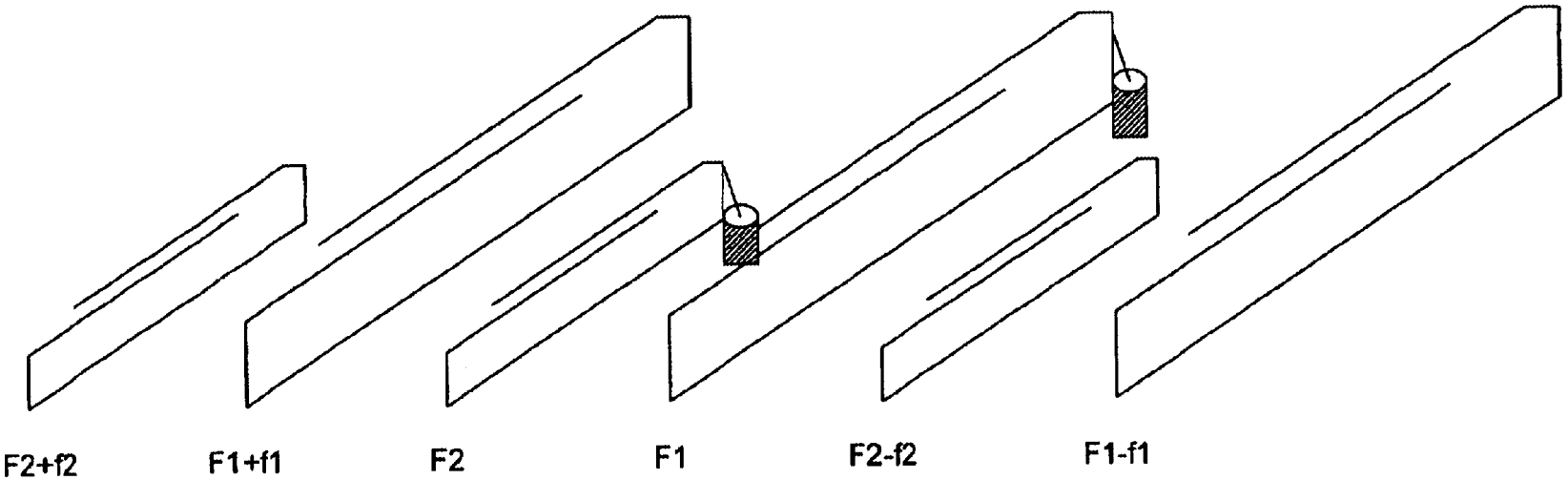
FIG. 11 is a perspective view of an antenna of the present invention comprising multiple elements, some tuned to a frequency f1 and some others tuned to a frequency f2.

FIG. 11 is a perspective view of an antenna structure composed of one driven element and multiple parasitic elements tuned to frequencies nearby the frequency f1 of the driven element and also to frequencies around another frequency f2 completely different from the driven element frequency. Multiple excited elements can also be considered in order to relax the constraints.

Figure 12:
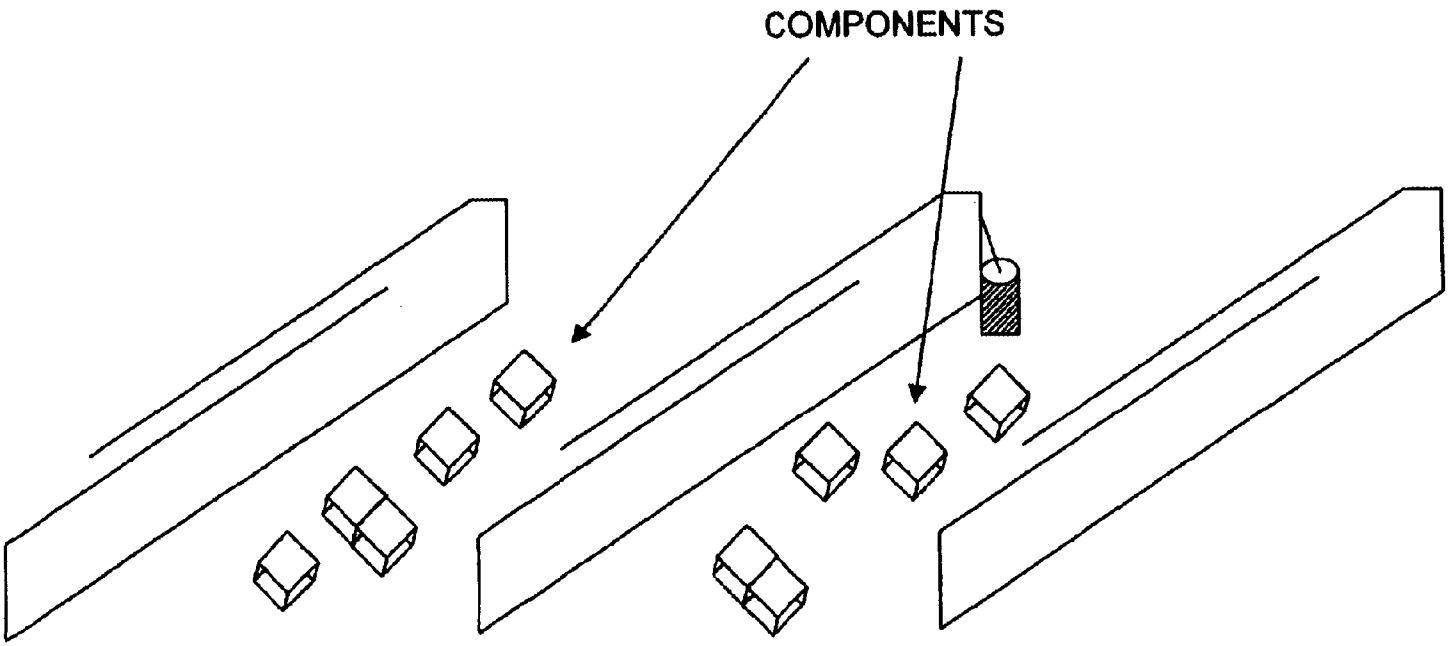
FIG. 12 shows how the antenna of the present invention can be implemented within an electronic device, with electronic components around it, without disturbing the antenna behavior.

One very interesting feature of the antenna structure presented here is that electronic and structural components can be inserted in between the different radiating elements as shown in FIG. 12 without disturbing the behavior of the overall antenna.

Figure 13:
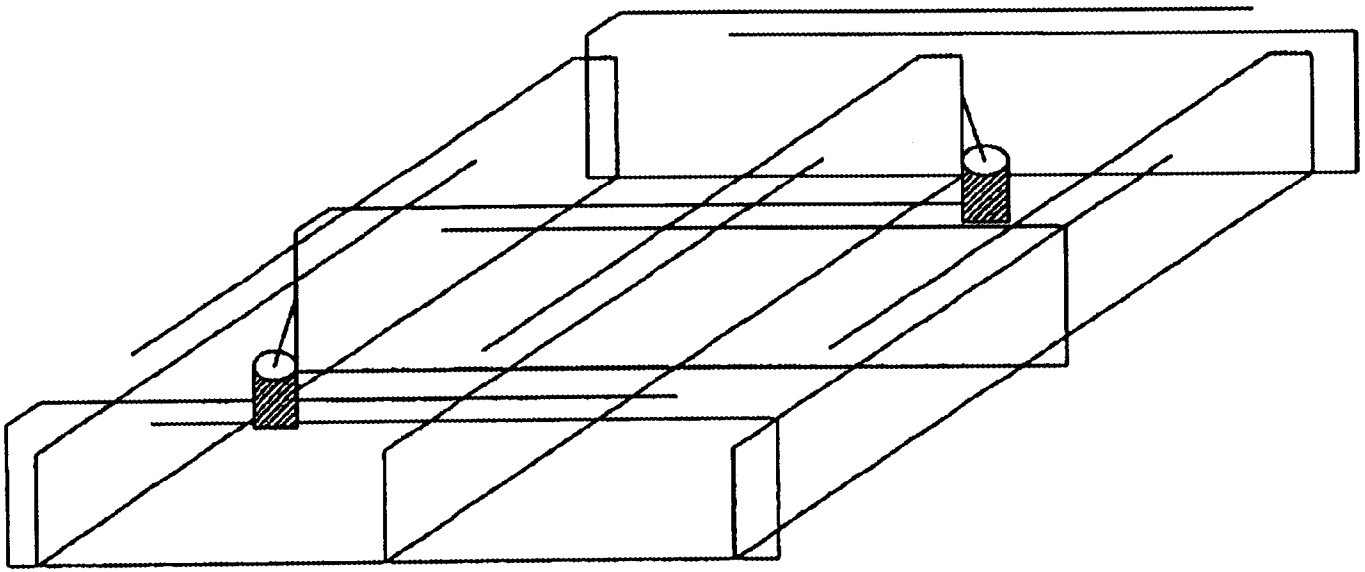
FIG. 13 illustrates an antenna of the present invention used in a polarization diversity context.
Figure 14C:
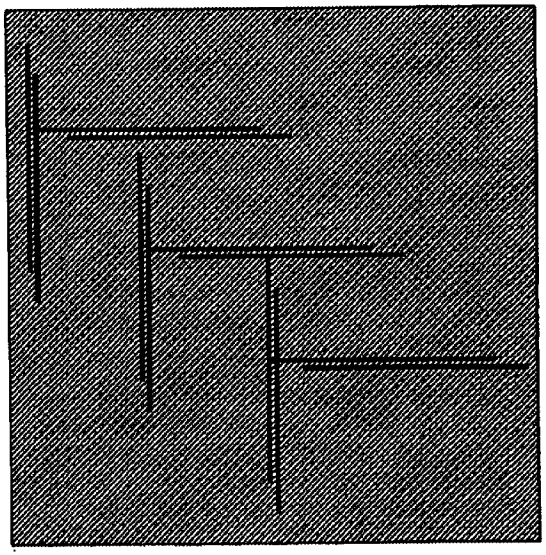
FIGS. 14*a*–14*d* illustrate antennas of the present invention designed to exhibit a plurality of frequency and/or polarization modes.
Figure 14D:
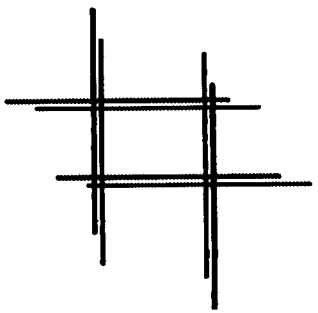
Figure 14A:
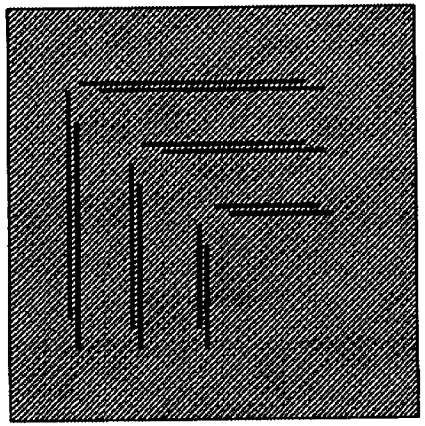
Figure 14B:
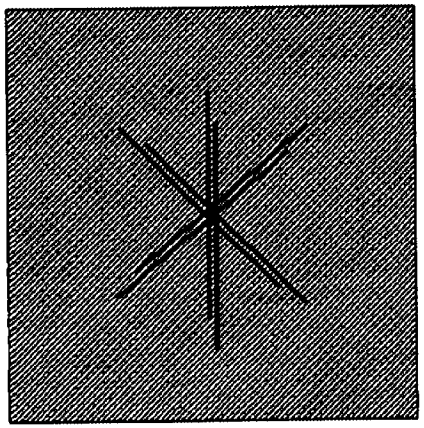

The use of orthogonal modes is important for achieving volume re-use. To be orthogonal, the modes must either be at slightly different frequencies or they must have orthogonal polarization. Two orthogonal polarized modes at the same frequency can be obtained by placing two radiating elements orthogonal to one another. For example, FIG. 13 shows a structure where two antennas composed of three elements each are placed orthogonally in order to obtain some polarization diversity in the same volume. Each antenna has its own feeding point and they both work within the same frequency band.

Figure 15:
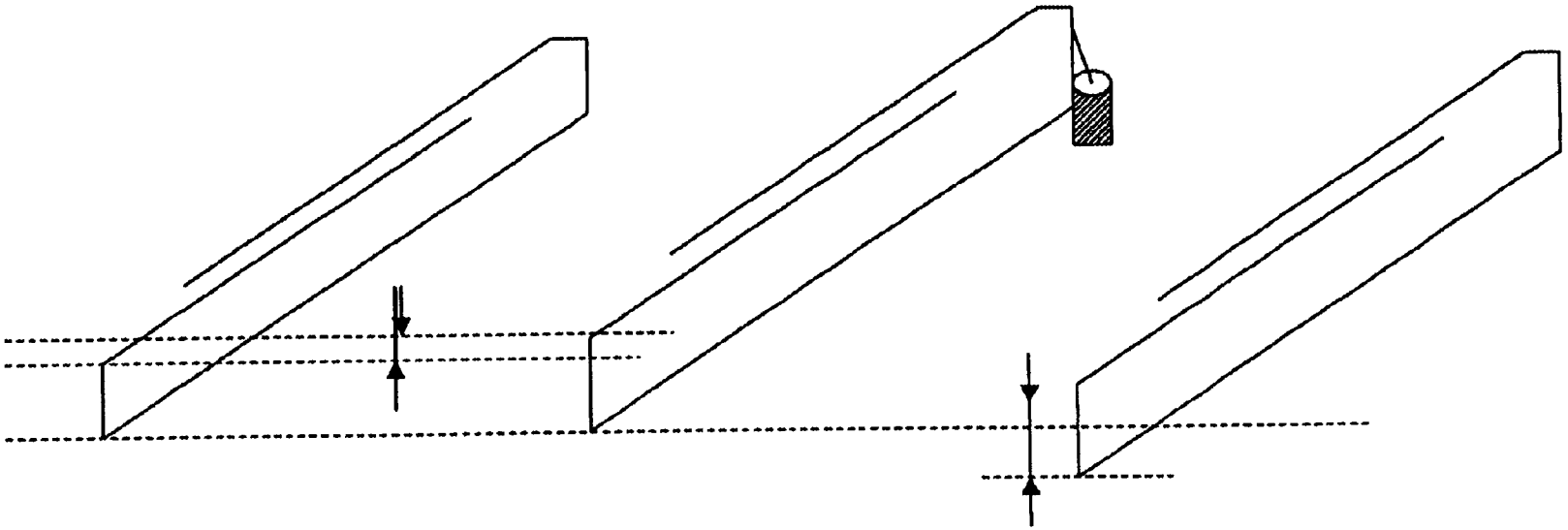
FIG. 15 illustrates an antenna of the present invention with radiating elements of different heights and placed at different levels.

Other different configurations can be considered depending on the electromagnetic characteristics targeted and the space available in the enclosure where the antenna has to be mounted. FIGS. 14*a*–14*d* present four other possibilities where multiple elements are placed using a plurality of modes (frequency and polarization). Where elements intersect, as in FIGS. 14*b* and 14*d*, the elements may or may not be in electrical contact at the different levels. As shown in FIG. 15, the different radiating elements do not have to have the same height and do not need to be on the same level.

Figure 16:
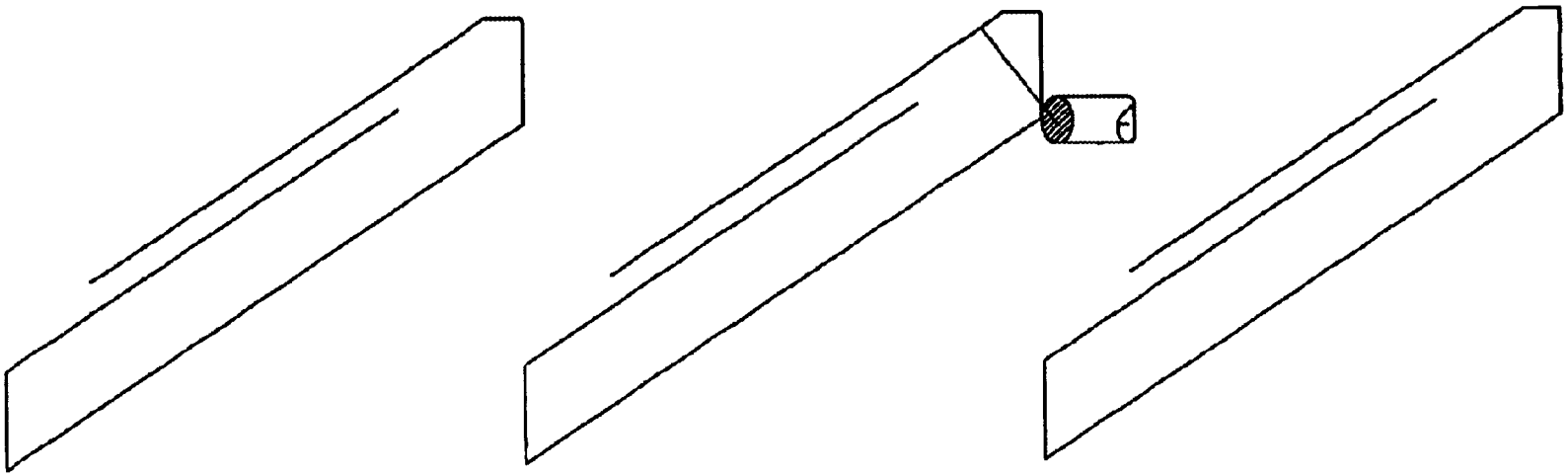
FIG. 16 illustrates an antenna of the present invention where the driven element is fed by a coaxial waveguide.
Figure 17:
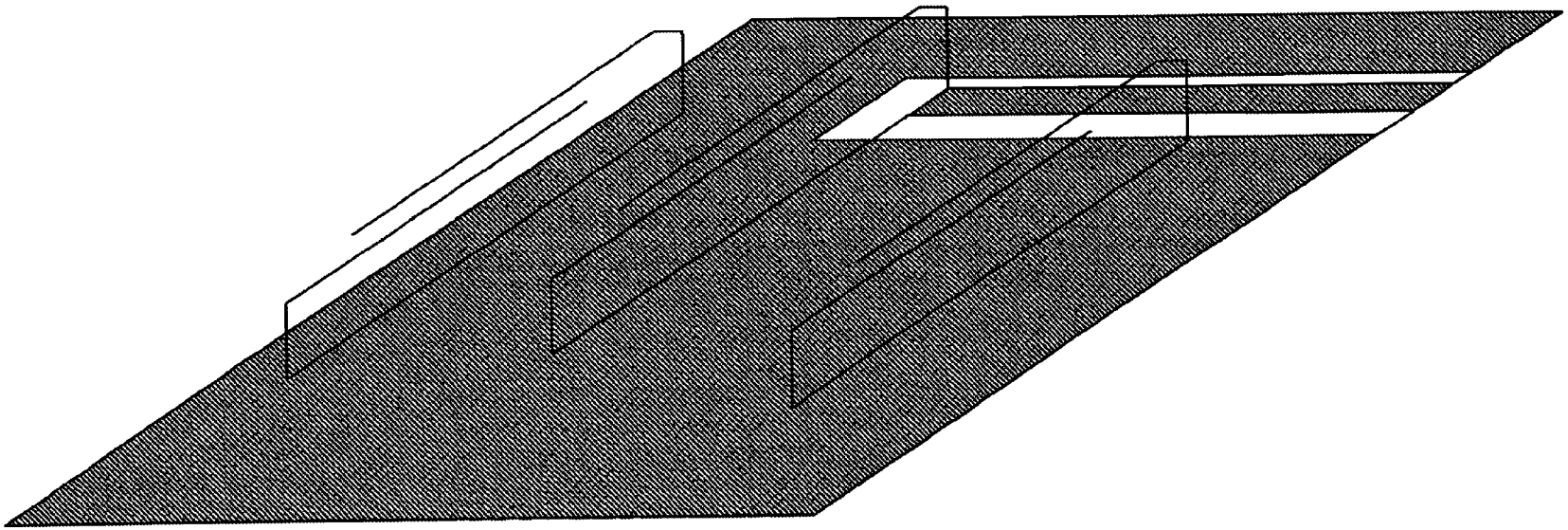
FIG. 17 illustrates an antenna of the present invention where the driven element is fed by a coplanar waveguide or a micro-strip line.

Different types of feed arrangements can be considered for this new capacitively loaded magnetic dipole. One of the most classic feeding solutions is to use a coaxial cable.; As shown in FIG. 16, the inner part of the coaxial cable is soldered to one point of the antenna and the outer part is soldered to another point, so that an inductance can be created in between to match the input to whatever impedance is needed. It is also possible to use a coplanar waveguide or micro-strip line as a feeding system as shown in FIG. 17. In such case, one point of the antenna is soldered to the central line, and another part of the antenna is soldered to the ground of the guide. When used with multiple elements working within one frequency band, only one element is connected to the line; the other elements are just passive. In the case of a multi-band antenna, different elements can be driven so that it is possible to match the antenna in the different frequency bands with only one feeding point. Multiple feeding points can also be used.

Figure 18:
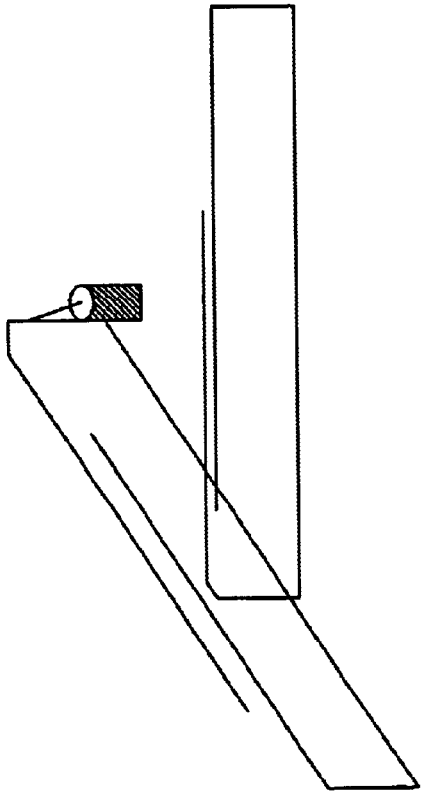
FIG. 18 illustrates an antenna of the present invention in a configuration where the radiated field has a circular polarization.

It is possible to obtain a circularly polarized antenna by placing two elements perpendicular to one another as shown in FIG. 18. The two elements must be placed in a non-symmetrical relationship so that the magnetic coupling between them does not cancel.

Figure 19:
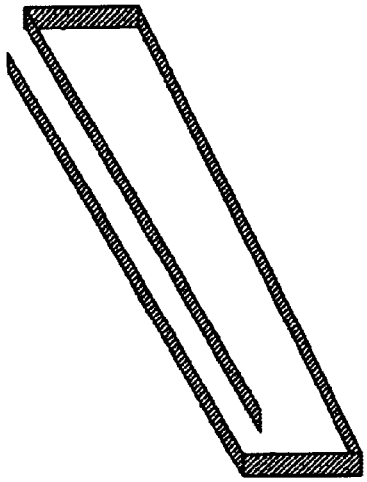
FIG. 19 shows how a basic element of the antenna can be made of conductive material.

The basic radiating element of a low profile capacitively loaded magnetic dipole antenna according to the present invention can be made in various ways. One approach utilizes a strip of a conductive material such as copper, which is simply folded in order to obtain the shape shown in FIG. 19. Tolerances can be maintained by using suitable stand-offs made of an insulating material such as a composite, for example.

A more complete solution is presented in FIG. 20. In this case, the two conductors of the radiating element are printed on a piece of flexible material with one pad at one extremity of each conductor. This piece of flexible material can then be mounted directly to the surface of the enclosure for the device, such as a cellular telephone, to which the antenna is connected. A circuit board within the enclosure may include the ground plane. Spring contacts may be mounted to the circuit board to make the electrical connection between the ground plane and the two conductors of the radiating element. The feeding system is simply printed on the circuit board and is placed right under the element.

Figure 21:
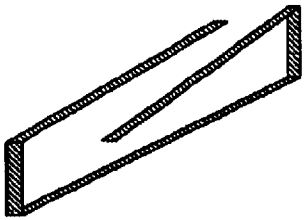
FIG. 21 shows an antenna of the present invention that is modified for increased bandwidth.

The radiating elements previously described are highly resonant and therefore exhibit a narrow bandwidth. In some applications, it is desirable to increase the bandwidth of the radiating element. One solution is to relax the field confinement inside the capacitance. One way of accomplishing this is to increase the gap between the conductors as shown in FIG. 21. While this is effective in reducing the capacitance and thereby increasing the bandwidth of the element, it also greatly increases the dimensions of the antenna.

Figure 22:
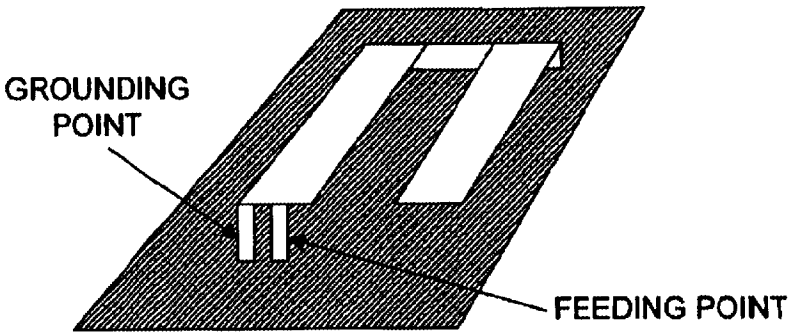
FIG. 22 illustrates an alternative antenna structure with increased bandwidth.
Figure 23:
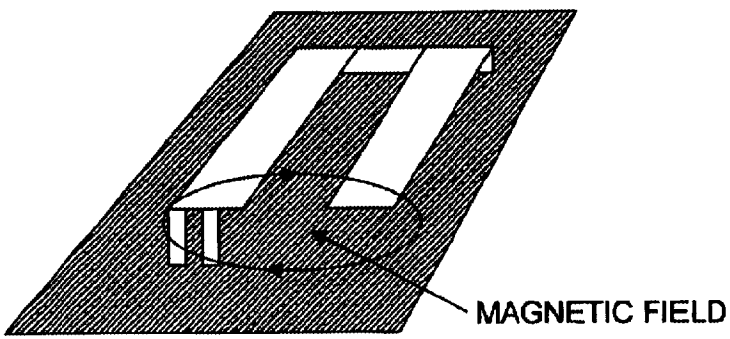
FIG. 23 illustrates the magnetic field of the antenna structure of FIG. 22.

Another solution is illustrated in FIG. 22. The radiating element comprises a generally "U"-shaped conductor connected to the ground plane at the base of the "U". One leg of the "U"-shaped conductor is short-circuited to the ground plane adjacent to the feed point. As a result, part of the current propagating along the top surface of the "U"-shaped conductor sees a capacitance where the electromagnetic field is confined and the rest of the current propagates along the conductor behaving like an inductance. As in the case of the highly resonant antenna element, the radiating characteristics of the "U"-shaped element are associated with the magnetic field expelled from the side of the antenna as shown in FIG. 23. Less electric field is confined inside the antenna and the bandwidth is greatly improved while still maintaining reasonably good isolation.

Figure 24:
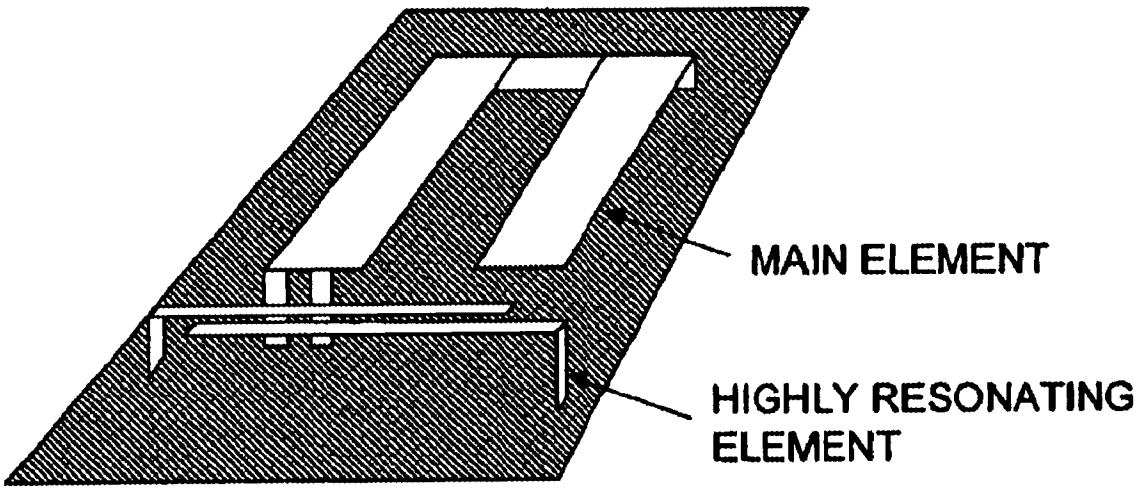
FIG. 24 illustrates a highly resonating antenna element of the present invention in combination with a wide-bandwidth element.

The distance between the two legs of the "U"-shaped conductor is very important since it defines the size of the current loop that expels the magnetic field. As with the previously described embodiments, one or more parasitic elements can be magnetically coupled to the driven elements as shown in FIG. 24. The parasitic element, which is shown here to be a highly resonant element, may be placed either to the side of the driven element or underneath it. This embodiment of the invention creates a capacitive portion of the antenna in a plane defined by the two legs and an inductive portion of the antenna located between the ground plane and the two legs.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An antenna comprising:

a ground plane;

a first conductor having a first length extending longitudinally above the ground plane and having a first end electrically connected to the ground plane at a first location;

a second conductor having a second length extending longitudinally above the ground plane and parallel to the first conductor, the second conductor having a first end electrically connected to the ground plane at a second location;

an antenna feed coupled to the first end of the first conductor; wherein the first conductor, second conductor, ground plane, and antenna feed are positioned to form a current distribution having a substantially circular cross-section; and wherein the first and second conductors are equidistant from the ground plane.

2. The antenna of claim 1 wherein the first and second conductors are both disposed on a single substrate and wherein the first and second conductors are arranged so that there is coupling between the first length and the second length.

3. The antenna of claim 2 wherein the single substrate comprises a flexible printed circuit substrate.

4. The antenna of claim 1 wherein the first length is approximately equal to the second length.

5. The antenna of claim 4 wherein the first location is spaced apart from the second location by a distance approximately equal to the first length.

6. The antenna of claim 1 wherein the first and second conductors comprise a first antenna element and further comprising a second antenna element having a third conductor and a fourth conductor.

7. The antenna of claim 6 wherein the second antenna element is a parasitic element.

8. The antenna of claim 6 wherein the first and second antenna elements are parallel to each other.

9. The antenna of claim 6 wherein the first and second antenna elements are non-parallel to each other.

10. The antenna of claim 6 wherein the third and fourth conductors are equidistant from the ground plane at a distance equal to a distance between the first and second conductors and the ground plane.

11. The antenna of claim 6 wherein the third and fourth conductors are equidistant from the ground plane at a distance different from a distance between the first and second conductors and the ground plane.

12. The antenna of claim 1 wherein the first and second conductors are arched above the ground plane.

13. The antenna of claim 12 wherein the first and second conductors are electrically connected to the ground plane with respective spring contacts.

14. An antenna comprising:

a ground plane;

an array of radiating elements, each of the radiating elements having a first conductor extending longitudinally above the ground plane and having a first end electrically connected to the ground plane at a first location, and a second conductor extending longitudinally above the ground plane and parallel to the first conductor, the second conductor having a first end electrically connected to the ground plane at a second location;

an antenna feed coupled to the first end of the first conductor of at least one of the radiating elements;

wherein the array of radiating elements, ground plane, and the antenna feed are positioned to create a current distribution having a substantially circular cross-section; and wherein the first and second conductor of each of the radiating elements are equidistant from the ground plane.

15. The antenna of claim 14 wherein the first and second conductors of each of the radiating elements are both disposed on a respective single substrate.

16. The antenna of claim 15 wherein each of the single substrates comprises a flexible printed circuit substrate.

17. The antenna of claim 14 wherein at least one of the radiating elements is a parasitic element.

18. The antenna of claim 14 wherein at least some of the radiating elements are parallel to each other.

19. The antenna of claim 14 wherein at least some of the radiating elements are orthogonal to at least some others of the radiating elements.

20. The antenna of claim 14 wherein all of the first and second conductors are equidistant from the ground plane.

21. The antenna of claim 14 wherein the first and second conductors of at least one of the radiating elements ate space 3 apart from the ground plane at a first distance and the first and second conductors of at least one other of the radiating elements are spaced apart from the ground plane at a second distance different from the first distance.

22. The antenna of claim 14 wherein each of the first conductors has a length and each of the second conductors has a length approximately equal to the length of a corresponding first conductor.

23. The antenna of claim 22 wherein the length of the first and second conductors of at least one of the radiating elements is different from the length of the first and second conductors of at least one other of the radiating elements.

24. An antenna comprising:

a ground plane;

a generally "U"-shaped conductor having the first and second parallel legs lying in a plane spaced apart from the ground plane;

an antenna feed coupled to a first end of the first leg;

a ground point, separate from the antenna feed, coupled to the first end of the first leg;

a short between the ground plane and at least one of the first and second legs;

a capactive portion of the antenna, located in a plane defined by the first and second legs;

an inductive portion of the antenna located between the ground plane and the first and second legs; and wherein the conductor, ground plate, ground point, and antenna feed are shaped and positioned to produce a current distribution having a substantially circular cross-section which encompasses sections of both the capacitive portion of the antenna and the inductive portion of the antenna.

25. The antenna of claim 24 wherein the short extends from the ground plane to the first end of the first leg.

26. The antenna of claim 24 further comprising a parasitic antenna element in proximity to the "U"-shaped conductor.

27. The antenna if claim 26 wherein the parasitic antenna element is disposed to a side of the "U"-shaped conductor.

28. The antenna of claim 26 wherein the parasitic antenna element is disposed between the plane of the "U"-shaped conductor and the ground plane.

29. The antenna of claim 26 wherein the parasitic antenna element comprises a first conductor having a first length extending longitudinally above the ground plane and having a first end electrically connected to the ground plane, a second conductor having a second length extending longitudinally above the ground plane and parallel to the first conductor, the second conductor having a first end electrically connected to the ground plane, wherein the first and second conductors are equidistant from the ground plane.

30. An antenna comprising:

a ground plane;

a first conductor having a first length extending longitudinally above the ground plane and having a first end and a second end, the first end electrically connected to the ground plane at a first location;

a second conductor having a second length extending longitudinally above the ground plane and parallel to the first conductor, the second conductor having a first end and a second end, the first end positioned opposite the first end of the first conductor and electrically connected to the ground plane at a second location, the second end of the second conductor extended longitudinally beyond the second end of the first conductor;

an antenna feed coupled to the first end of the first conductor;

wherein the first and second conductors are equidistant from the ground plane and wherein the ground plane, the first conductor, the second conductor, and the antenna feed are positioned to create a substantially circular current distribution.

* * * * *